United States Patent [19]

Lindahl

[11] Patent Number: 4,578,148

[45] Date of Patent: Mar. 25, 1986

[54] PROCESS FOR MANUFACTURING BRIGHT AND STRONG BLEACHED GROUNDWOOD PULP OF UNIFORM QUALITY

[75] Inventor: Jonas A. I. Lindahl, Domsjö , Sweden

[73] Assignee: Mo och Domsjo Aktiebolag, Ornskoldsvik, Sweden

[21] Appl. No.: 667,314

[22] Filed: Nov. 1, 1984

Related U.S. Application Data

[63] Continuation of Ser. No. 479,587, Mar. 28, 1983, abandoned, which is a continuation of Ser. No. 281,434, Jul. 8, 1981, abandoned.

[30] Foreign Application Priority Data

Jul. 9, 1980 [SE] Sweden ..... 8005034

[51] Int. Cl.[4] ..... D21C 1/16

[52] U.S. Cl. ..... 162/26; 162/28; 241/21; 241/28

[58] Field of Search ..... 162/26, 27, 28, 24, 162/25, 78, 20; 241/21, 28

[56] References Cited

U.S. PATENT DOCUMENTS

| | | | |
|---|---|---|---|
| 1,633,733 | 6/1927 | Fish, Jr. | 241/28 |
| 2,050,749 | 8/1936 | Mers | 162/28 |
| 3,690,568 | 9/1972 | Alexander | 241/28 |
| 4,017,356 | 4/1977 | Bystedt | 162/26 |
| 4,029,543 | 6/1977 | Lindahl | 162/24 |

*Primary Examiner*—Steve Alvo

[57] ABSTRACT

A process for manufacturing bleached groundwood pulp of improved and uniform quality, in which debarked wood logs or wood chips are ground in a closed pocket grinder at atmospheric or super-atmospheric pressure, while applying shower water to the free surfaces of the grindstone, and shower water containing bleaching chemicals to the grinding zone where the wood is in contact with the grindstone, i.e., such as by spraying such shower water upon the end portions of the logs or chip mass, optionally combined with a supply of shower water delivered via the ram plates and a water trap arranged around the lower part of the log pockets facing the grindstone, so as to maintain a high uniform level of moisture content in the grinding zone, and to retain the shower water within said zone to an extent such that hollows between the logs or chips located nearest the surface of the stone are also filled with shower water; the wood can thus be brought into effective contact with bleaching chemicals at an early stage, resulting in a pulp of high brightness.

20 Claims, 3 Drawing Figures

PROCESS FOR MANUFACTURING BRIGHT AND STRONG BLEACHED GROUNDWOOD PULP OF UNIFORM QUALITY

This is a continuation of application Ser. No. 479,587, filed Mar. 28, 1983, now abandoned, which in turn is a continuation of Ser. No. 281,434, filed July 8, 1981, now abandoned.

Groundwood pulp is normally produced from debarked logs. According to U.S. Pat. No. 4,247,363, patented Jan. 17, 1981, to Soma et al, it is also possible to produce groundwood pulp from wood chips. The wood material is placed against a rotating grindstone, loosening and releasing the wood fibers at the surface of the wood in abrasive contact with the grindstone. The grinder may operate at atmospheric or at superatmospheric pressure.

The heat generated during grinding of the logs is dissipated by spraying water onto the grinding surface of the grindstone, cooling and cleaning it, the shower water normally being applied at an oblique angle to the free surfaces of the grindstone both in the direction of rotation of the grindstone and in the opposite direction. The shower water can be applied at an angle of about 90° to the suspension and drive shaft of the grindstone, and since the logs are brought into contact with the grinding surface while lying parallel to the shaft of the stone, the shower water is also applied at an angle of about 90° to the longitudinal axis of the logs.

The free fibers obtained during the grinding operation are collected together with shower water in the grinder pit or basin. The pulp concentration of the resultant pulp suspension normally varies between 0.5 and 2%, calculated as bone dry pulp.

Shearer U.S. Pat. No. 2,413,583, patented Dec. 31, 1946, provides a method for preparing a greatly improved bleached groundwood pulp product, in that the increase of brightness during the bleaching may be made, for example, nearly twice as great as with the formerly known groundwood bleaching methods, with the same or lesser amounts of bleach, and the process is carried out in such manner that the product is softened and improved in texture and uniformity.

The bleaching liquor is applied preferably at or closely adjacent the point where the grinding of the wood takes place. At this point the pulp is subjected to the highest temperature which it reaches at any point during the process of pulp production. Due to friction, the surface of the grindstone at the point of abrasion of the wood may reach temperatures in the neighborhood of or possibly substantially in excess of 235° F. Application of the bleach liquor at this point of high temperature is said not only not to injure or detract from the effectiveness of the bleaching agent, but unexpectedly gives a bleaching action that is very rapid and efficient, and to a considerable degree takes place substantially instantaneously. For best results, the bleaching action is allowed to continue for a relatively short controlled period, as the pulp passes to and through various treatment steps prior to the pulp storage.

However, the frictional heat generated by contact of the wood with the grinding surface of the grindstone dries out the wood in that area, and when the wood has a low moisture content, the wood may even become overheated, with deleterious effect on the pulp properties. Moreover, as the moisture content of the wood decreases, the temperature at which the lignin softens increases. This results in a pulp having relatively short fibers, which when used for paper manufacture results in a paper having, among other things, a low tear strength. The magnitude of these described effects and therefore the quality of the resultant groundwood pulp varies with the moisture content of the wood.

If the temperature at the grinding surface (the area in which wood and grindstone are in surface contact with each other) rises so high that the fibers become discolored, this results in a pulp of low brightness, and, furthermore, in a high consumption of chemicals in any subsequent bleaching step.

U.S. Pat. No. 4,029,543 to Lindahl, patented June 14, 1977, suggests that in the manufacture of groundwood pulp, if the shower water contains or is bleaching waste liquor taken from a peroxide bleaching step, brighter pulps are obtained. The patent provides a process for the preparation of a cellulose pulp by mechanically freeing wood fibers in a grinder to form a fibrous pulp and bleaching the fibrous pulp with a peroxide-containing bleaching agent, as the only bleaching agent, in a peroxide bleaching stage, the mechanical freeing of the fibers being carried out in the presence of a spent liquor from the peroxide bleaching stage have a pH of 7 to 9. One can for the same reason introduce bleaching chemicals into the system when defibrating chips in a disc refiner. However, when this is done, the quantity of chemicals consumed is much higher than when bleaching in a tower. It is also known that when defibrating chips in a disc refiner the energy consumed is from 50 to 100% higher than when grinding wood logs against a grindstone.

Thus, in summary, in preparing groundwood pulp by grinding wood against the surface of a grindstone, while supplying shower water solely to the free surfaces of the grindstone, it is difficult to obtain a strong and bright pulp of uniform quality, owing to the fact that it is difficult to maintain the moisture content of the wood at a uniform level.

In accordance with the present invention, undesirable drying of the wood in the grinding zone due to frictional heat generated at the surface of the grindstone is inhibited, by applying additional shower water containing fresh bleaching chemicals to the grindstone within the area where the wood and the grindstone are in surface contact with each other, i.e., to the grinding surface, and to regions of the wood charge located immediately above the surface of the stone.

Therefore, in the process of the invention the shower water is applied both onto the free surfaces of the grindstone at an acute angle and, in addition, to the grindstone within the area where the wood and the grindstone are in surface contact with each other, i.e., directly to the grinding surface, and to portions of the wood charge located immediately above the surface of the grindstone, preferably at an angle within the range from about 0° to about 60°. These are collectively referred to herein as the "grinding zone".

This method of applying additional shower water directly to the grinding zone of the wood has surprisingly been found to prevent undesirable drying of the wood in the course of the frictional heating resulting from its being thrust against the surface of the grindstone, and thus holds the moisture content of the wood at any desired high and uniform level.

As a result, the moisture content of the wood can be held at a desired high and uniform level, while subjecting the released wood fibers to a bleaching process at the earliest possible stage, by the bleaching chemicals contained in the shower water.

It has been found particularly advantageous to introduce the shower water containing fresh bleaching chemicals to one end portion or to both end portions of the logs or chip mass under high pressure, and to direct the supply of shower water substantially parallel with the longitudinal axis of the logs or chip mass. In this way, the hollows located between the lowermost logs or chips nearest the grindstone in each wood pocket are also filled with shower water, which actively contributes to maintaining a high and uniform level of moisture in the grinding zone.

Accordingly, the process of the invention for manufacturing bleached groundwood pulp of improved and uniform quality comprises grinding wood as logs or in particulate form in a closed pocket grinder under atmospheric or superatmospheric pressure, while applying shower water to the free surfaces of the grindstone, and shower water containing bleaching chemicals to the grinding zone where the wood is in contact with the grindstone, i.e., such as by spraying such shower water upon the end portions of the logs, or the mass of wood particles, such as chips, optionally combined with a supply of shower water delivered via the ram plates of each pocket and a water trap arranged around the lower part of the pockets facing the grindstone, so as to maintain a high and uniform level of moisture content in the grinding zone, and to retain the shower water within said zone to an extent such that hollows between the logs or particles located nearest the surface of the stone are also filled with shower water; the wood can thus be brought into effective contact with bleaching chemicals at an early stage, resulting in a pulp of high brightness. A "pocket grinder" is a grinder in which the wood is pressed against the grindstone from radially arranged wood pockets.

When introducing the shower water containing fresh bleaching chemicals to the end portions of the logs, or to the mass of wood chips, it has also been found particularly suitable to arrange some form of water trap at the lowermost part of each wood pocket. Such a water trap may suitably comprise plates or like elements mounted on the two plane ends and sides of the grindstone, and connected with other plates around each wood pocket, in a manner such as to hold the shower water within the grinding zone to the greatest possible extent, and therewith to enable the hollows located between the logs or chips nearest the stone surface to be filled with shower water.

The shower water containing fresh bleaching chemicals is suitably introduced into the grinding zone of the logs or chips via spray pipes, through fine holes made in said pipes or through nozzles fixedly mounted on the pipes, or on pipe headers, it having been found that the superatmospheric pressure of the shower water should be maintained within the range from about 0.5 to about 40 kp/cm$^2$, preferably from 5 to 30 kp/cm$^2$, above atmospheric. The shower water pipes, together with any holes or nozzles, may be fixedly mounted on the grinder, or may be arranged for oscillatory movement. The shower water can be applied continuously or intermittently, at intervals of five to ten seconds. The vertical distance between the peripheral surfaces of the grindstone and the nearest spray locations thereabove should suitably be greater than 10 mm.

When it is said that the shower water is supplied "substantially in parallel with the longitudinal axis of the logs or chip mass", it is meant that the central parts of the spray projected straight from the holes or nozzles strike the surfaces of the logs or chips at an angle within the range from 0° to about 60°, preferably from 0° to 15° to the longitudinal axis of the logs or chips.

In another suitable method of introducing shower water containing fresh bleaching chemicals to the logs or chips supplemental to the aforementioned method of supplying shower water via spray pipes, the shower water is also directed onto the logs or chips from above in the pockets through openings or nozzles arranged in the ram plates. This method of supplying shower water actively contributes to filling the hollows between the lowermost logs or chips located nearest the surface of the grindstone, and assists therewith in maintaining a desired high and uniform level of moisture in the grinding zone.

The flow of shower water from all sources is suitably so controlled that the water introduced directly into the grinding zone is at a rate within the range from about 500 to about 600 liters/minute for each ton of pulp produced per hour. Thus, the total amount of shower water supplied per ton of pulp per hour may be between 100 and 2000 liters/minute, since the amount of shower water introduced to the free surfaces of the grindstone normally varies between 50 and 1400 liters/minute.

It has been found of particular advantage to use pure shower water, which can be obtained by filtering the shower water in a means suitable therefor, such as a curved screen, a drum filter, a centrifuge, or a special filter. Thus, for example, shower water which has been ultrafiltered can be used to particular advantage.

The temperature of the shower water introduced to the grinding zone should be within the range from about 65° to about 120° C., preferably from 80° to 105° C., this latter range having been found particularly advantageous.

The method according to the invention by introducing additional shower water to the grinding zone produces groundwood pulp which is stronger and brighter and of more uniform quality than groundwood pulp produced in accordance with the usual shower water application techniques. A further important advantage is that a high quality groundwood pulp can be produced from wood which has been stored, and which, as a result thereof, has a low moisture content. Further drying of the wood during the grinding process can be entirely prevented, thereby practically eliminating any risk of deleterious overheating. This also prevents the grindstone from being damaged by heat, thereby increasing the useful life span of the grindstone. The present invention can maintain a uniform temperature and moisture content throughout the grinding zone, which advantageously affects the properties of the pulp, and the useful life span of the grindstone. Since interruptions in production result in significant economic losses, it is of particular importance and to particular advantage that losses in production due to grindstone damage caused by overheating are practically totally eliminated.

Moreover, the brightness of the groundwood pulp produced in accordance with the invention is so high as to normally render it unnecessary to subject the pulp to a subsequent bleaching step.

Because of the optimal distribution of the flow of shower water within the grinder, it is possible to reduce the total amount of shower water required. This reduction in the flow of shower water results in a higher pulp consistency in the resultant pulp suspension. This is of particular advantage when the pulp is to be stored in a tower subsequent to leaving the grinder, since the tower can then be made relatively smaller, and may serve at the same time as a buffer tank. The tower may also be used for subsequent bleaching of the pulp suspension from the grinder. Due to the higher pulp consistency, it is cheaper to dewater the pulp suspension prior to drying.

Groundwood pulp produced in accordance with the invention has a high brightness and a high content of long and flexible fibers, which gives a strong paper which is light in color. The aforementioned properties of the pulp can also be utilized in the manufacture of paper having good optical and mechanical properties, but with a lower grammage than normal. Further, when mixed with chemical pulp, such as sulfate pulp or sulfite pulp, the pulp manufactured in accordance with the invention can be utilized in greater quantities than normal, thereby enabling the cost of manufacturing wood-containing paper to be reduced. The pulp is also suitable as a starting material in the manufacture of paper within a broader and more variable quality range than is normal for pulps with a yield within the range from 92 to 98%. This is due to the high degree of brightness of the resultant pulp, its high percentage of long fibers, and its great strength.

FIG. 1 is a cross-sectional view of a grindstone which is sprayed with shower water in conventional manner, with the shower water directed at an acute angle onto the free surfaces of the grindstone, designated A and B in the Figure, from four locations;

Figure 1:
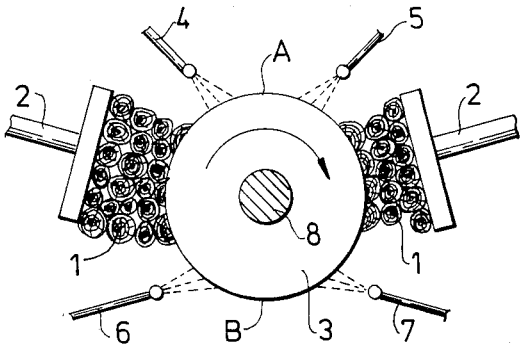
FIGS. 1 to 3 illustrate schematically a conventional shower water application technique and also the method according to the invention.
Figure 2:
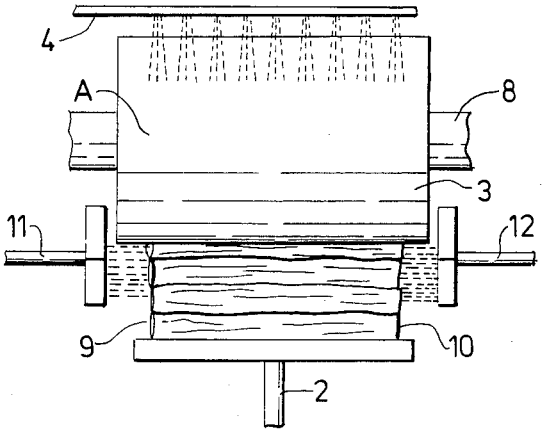
Figure 3:
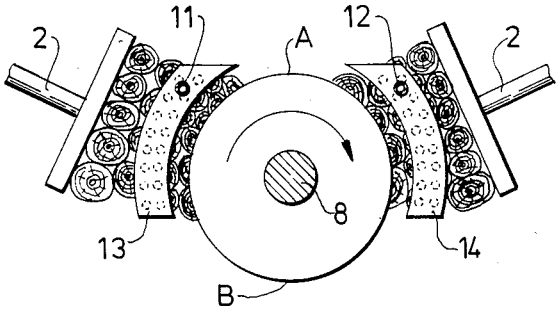

FIG. 2 is a top plan view of a grindstone where in addition to directing shower water directly onto the free surfaces of the grindstone as in FIG. 1, shower water is also applied in accordance with the present invention; and FIG. 3 is a schematic cross-sectional view of a grinder in which shower water is applied in accordance with the present invention, the supply of shower water onto the free surfaces of the grindstone having been omitted, in order to illustrate the method according to the invention more clearly.

In the closed pocket grinder of FIG. 1, debarked logs 1 having a moisture content of between 20 and 70% are pressed heavily against the grindstone 3 by means of rams 2, the ram pressure suitably being from 4 to 40 kp/cm$^2$. Atmospheric pressure or a superatmospheric pressure which may reach 10 kp/cm$^2$ above atmospheric is normally maintained within the grinder. During the grinding operation, the shower water is supplied via pipes 4,5,6,7, and is delivered to the free surfaces A, B of the grindstone at oblique angles, but at right angles to the suspension and drive shaft 8 of the grindstone.

As shown in FIGS. 2 and 3, in accordance with the invention, shower water containing fresh bleaching chemicals is also supplied to the grinding zone, being applied at both end portions 9, 10 of the logs from spray headers 13, 14, provided with nozzles and mounted on spray pipes 11, 12. The spray direction of the shower water is substantially in parallel with the longitudinal axis of the logs, but it can be at any angle up to about 60° to the surface of the logs. The angle preferably should not exceed 15°, however.

The shower water supplied directly onto the free surfaces of the grindstone normally is at a superatmospheric pressure of between 0.5 and 30 kp/cm$^2$ above atmospheric, while the shower water containing fresh bleaching chemicals and introduced to the grinding zone is at a superatmospheric pressure between 0.5 and 40 kp/cm$^2$, preferably between 5 and 30 kp/cm$^2$, above atmospheric.

The shower water which is introduced to the grinding zone in accordance with the invention can contain one or a mixture of several bleaching chemicals, such as sodium peroxide, hydrogen peroxide and peracetic acid, but it is also possible to use other technically useful peroxide bleaching agents. Especially useful for the process of the invention is hydrogen peroxide. Other bleaching chemicals suitable for use in the shower water include sodium dithionite, zinc dithionite, hydroxylamine, sodium bisulfite, boron hydride and thioglycolic acid. Other oxidizing or reducing bleaching chemicals can also be used to advantage in the shower water. The pH of the shower water is suitably regulated so as to be within the range from about 3 to about 14, preferably from 5 to 12.

The addition of bleaching agents is preferably combined with an addition of complexing agents for heavy metals, such as for instance aminocarboxylic acids of the general formula:

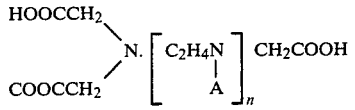

or alkali metal or magnesium salts thereof, in which formula A is the group —$CH_2COOH$ or —$CH_2CH_2OH$ and n is an integer from 0 to 5. Examples of such acids are ethylenediaminetetraacetic acid (EDTA), nitrilotriacetic acid NTA), diethylenetriaminepentaacetic acid, ethylenediaminetriacetic acid, tetraethylenepentaamineheptaacetic acid, hydroxyethylenediamine triacetic acid and their alkali metal salts, including mono, di, tri, tetra and penta sodium, potassium and lithium salts thereof. Also other types of aminocarboxylic acids, such as iminodiacetic acid, 2-hydroxyethyliminodiacetic acid, cyclohexane-diaminetetraacetic acid, anthranil-N,N-diacetic acid and 2-picolylamine-N,N-diacetic acid may be used. Especially suitable complex formers for use in the bleaching chemicals according to the present invention are ethylenediaminetetraacetic acid and diethylenetriaminepentaacetic acid.

Examples of heavy metal organic complexing acids which may be present in the spent bleaching liquor are aliphatic alphahydroxycarboxylic acids of the type RCHOHCOOH and corresponding betahydroxy-carboxylic acids with the formual $RCHOHCH_2COOH$, in which formula R is hydrogen or an aliphatic radical, which may be a hydrocarbon radical with from one to ten carbon atoms or a hydroxy substituted hydrocarbon radical with from one to nine hydroxyl groups and from one to ten carbon atoms, such as glycolic acid, lactic acid, 1,2-dihydroxypropionic acid, alpha,beta-dihydroxybutyric acid, beta-hydroxy-n-valeric acid and sugar acids and aldonic acids, such as gluconic acids, galactonic acid, mannonic acid and saccharinic acid.

To the bleaching chemicals it is also possible to add magnesium compounds, which decrease the degradation of the cellulose under the oxidation process. Examples of such magnesium compounds are magnesium oxide, magnesium hydroxide, magnesium carbonate, magnesium chloride, magnesium nitrate, magnesium acetate, magnesium sulfate and magnesium complexes with any of the complex-forming acids mentioned above. The magnesium compounds may be added in an amount corresponding to 0.01 to 0.5% calculated as MgO based on the dry weight of the wood.

The bleaching chemicals content of the shower water can be varied in accordance with requirements, including the desired brightness of the resultant groundwood pulp. The bleaching chemicals concentration, calculated in grams/liter, is dependent on the amount of shower water supplied to the grinding zone. The bleaching chemical charge, calculated in percent by weight of bone dry wood, is suitably within the range from about 0.3 to about 5%. Suitable charges of back-up chemicals are, in this case (when peroxide bleaching):

| | Range |
|---|---|
| Waterglass | 0.5 to 9% |
| Sodium hydroxide | 0.5 to 3% |
| Magnesium sulfate | 0.01 to 0.5% |
| Chelating agent | 0.05 to 0.5% |

The rate of application of shower water applied may be between 100 and 2000 liters/minute for each ton of pulp produced per hour. That part of the total volume of shower water containing bleaching chemicals can be applied at a rate of from 50 to 600 liters/minute.

That part of the shower water delivered to the free surface of the grindstone in the conventional way can also advantageously contain chemicals, which primarily comprise residual chemicals obtained from bleaching waste liquor originating from a separate bleaching stage. Additive chemicals, such as chelating agents, sodium bisulfite, and alkali, can also be used to advantage. This shower water should suitably have a temperature within the range from about 30° to about 120° C.

The process of the invention is applicable to any kind of wood. In general, softwood such as spruce and pine can be ground more easily than hardwood such as beech and oak, but both types of wood can be ground satisfactorily using this process. Exemplary hardwoods which can be ground include birch, beech, poplar, cherry, sycamore, hickory, ash, oak, chestnut, aspen, maple, alder and eucalyptus. Exemplary softwoods include spruce, fir, pine, cedar, juniper and hemlock.

The wood can be in the form of logs, or large pieces, or even in small particulate form, such as wood chips having dimensions that are conventionally employed in pulping processes. Wood slivers and splinters, wood granules, and wood chunks, and other types of wood fragments can also be used.

The groundwood pulp that is obtained in accordance with the process of the invention can easily be bleached in accordance with known methods by treatment with chlorine, chlorine dioxide, chlorite, hypochlorite, peroxide, peracetate, oxygen or any combinations of these bleaching agents in one or more bleaching sequences as described in, for example, U.S. Pat. No. 4,160,393, patented July 10, 1979 to Lindahl, particularly column 3, lines 32 to 48, inclusive.

Preferred embodiments of the invention are described in the following working examples, which include controls for comparison with the conventional shower water application method.

EXAMPLE 1

This Example illustrates the manufacture of bleached groundwood pulp from debarked spruce wood in accordance with the method of the invention, wherein shower water containing fresh bleaching chemicals is applied to the end portions of the logs. By way of comparison, groundwood pulp was also produced in accordance with the known shower water application technique (Control 1), the shower water being applied only directly to the free surfaces of the grindstone.

One of nine pocket grinders in a groundwood pulp plant was complemented with spray pipes so as to enable shower water to be applied to the end portions of the logs in accordance with the method illustrated in FIGS. 2 and 3. Debarked spruce logs having an average moisture content of 53% were charged to the grinder. The logs were pressed against the surface of the grindstone at a pressure of 9 kg/cm$^2$. At this ram pressure, the mean power of the motor driving the grindstone was found to be 1950 kW.

The logs were ground at atmospheric pressure in the grinder, which was well sealed to prevent the loss of vapor formed by friction of the wood against the grindstone. The groundwood pulp suspension obtained was discharged from the grinder through a closed conduit. In order to recover heat from the vapor, a suction fan was connected to the conduit. The fan conveyed the hot vapor to a heat exchanger. Air was heated in the heat exchanger to a temperature of about +5° C. to about 40° C. This preheated air was used for flash-drying the pulp.

Samples of the groundwood pulp suspension were removed from the closed conduit, for the purpose of testing the pulp and paper properties thereof, and part of the samples was placed in cans for subsequent bleaching. The cans were placed in a water bath having a maintained temperature of 80° C.

In the example carried out in accordance with the method of the invention, the temperature of the shower water applied to the free surfaces of the grindstone was 78° C. This shower water also contained bleaching waste liquor obtained from a peroxide bleaching step, and the content of residual chemicals originating from the bleaching waste liquor is given below:

| | |
|---|---|
| Hydrogen peroxide (100%) | 0.62 g/l |
| $Na_2SiO_3$ (waterglass) | 1.95 g/l |
| Diethylenetriamine pentaacetic acid (DTPA) | 0.05 g/l |
| Acetic acid | 0.80 g/l |
| Resin and fatty acids | 0.14 g/l |
| Measured pH | 8.1 |

The shower water was applied directly to the free sections of the grindstone at a rate of 700 liters/minute and was discharged at a superatmospheric pressure of 9 kp/cm$^2$ above atmospheric.

In this case, the same shower water as that described above was applied to the end portions of the logs, to which fresh bleaching chemicals had been added so as to give the following composition:

| | |
|---|---|
| Hydrogen peroxide | 3.50 g/l |
| $Na_2SiO_3$ (waterglass) | 6.00 g/l |
| Diethylenetriamine pentaacetic acid (DTPA) | 0.60 g/l |
| Resin and fatty acids | 0.12 g/l |

-continued

| | |
|---|---|
| Measured pH | 10.9 |

The shower water was applied to the end portions of the logs at a temperature of 90° C., and a rate of 100 liters/minute. The water was discharged at superatmospheric pressure of 10 kp/cm$^2$ above atmospheric. Thus, the total volume of shower water applied in this Example was at a rate of 800 liters/minute. The production of bone dry pulp was calculated at 28 kg/minute. Thus the total charge of bleaching chemicals applied with the shower water to the end portions of the logs comprised the following percentages, calculated on bone dry wood:

| | |
|---|---|
| Hydrogen peroxide | 1.25% |
| $Na_2SiO_3$ | 2.15% |
| Diethylenetriamine pentaacetic acid (DTPA) (100%) | 0.22% |

Because the shower water applied to the free surface of the grindstone also contained bleaching waste liquor, there was obtained in this case a considerable additional contribution of bleaching chemicals, as evident from the following:

| | |
|---|---|
| Hydrogen peroxide | 1.55% |
| $Na_2SiO_3$ | 4.85% |
| Diethylenetriamine pentaacetic acid (DTPA) | 0.30% |

Thus during this example, in total the following amounts of bleaching chemicals were supplied, via all the shower water used:

| | |
|---|---|
| Hydrogen peroxide | 2.80% |
| $Na_2SiO_3$ | 7.00% |
| Diethylenetriamine pentaacetic acid (DTPA) | 0.52% |

The aforegiven percentage of DTPA is seemingly high, owing to the fact that a predominant part of the chelating agent originating from the bleaching waste liquor has already bound to complex form, i.e., has already been consumed.

Pulp samples were taken from the closed conduit, screened in a laboratory screen, and then formed into sheets and tested for paper properties. In parallel with these samples, further samples were taken and put into cans, which were placed in a water bath maintained at a temperature of 80° C. The cans were left in the water bath for twenty minutes, after which the samples were washed and formed into sheets, and their brightness measured. The results are set forth in Tables I and II. Table II gives the results for the samples after their additional bleaching in the water bath.

Control 1

The same grinder as that used in Example 1 was used, but the supply of shower water through the pipes 11 and 12 was stopped. Thus, in this case shower water was only applied to the free surfaces of the grindstone. This shower water contained bleaching waste liquor, as in Example 1. The shower water was applied at a rate of 1600 liters/minute, and the discharge pressure was 9 kp/cm$^2$ above atmospheric. The temperature of the shower water was 70° C. The bleaching chemical charge, calculated on bone dry wood, was as follows:

| | |
|---|---|
| Hydrogen peroxide | 3.5% |
| $Na_2SiO_3$ | 11.1% |
| Diethylenetriamine pentaacetic acid (DTPA) | 0.28% |

The pulp was treated in the same manner as Example 1. The results are set forth in Table I.

TABLE I

| | Control 1 | Example 1 |
|---|---|---|
| Canadian Standard Freeness, ml | 120 | 110 |
| Long fiber content according to Bauer McNett (+30 mesh) % | 13 | 26 |
| Tensile index, Nm/g | 36 | 44 |
| Tear index, mNm$^2$/g | 3.5 | 5.5 |
| Density, kg/m$^3$ | 391 | 378 |
| Brightness according to SCAN, % | 69 | 76 |

As seen from the Table, the pulp produced in accordance with the invention (Example 1) has a surprisingly high content of long fibers. Thus, the long fiber content of the pulp produced in accordance with the invention is 100% greater than that of groundwood pulp produced by the conventional spraying technique (Control 1). It is particularly surprising that pulp produced in accordance with the invention has a substantially higher tear index. This increase in tear index is probably due to the high percentage of long fibers.

The high brightness, obtained directly after the grinder, must be considered particularly surprising, in view of the fact that the total peroxide charge only reached 2.8% in the method according to the invention, as opposed to 3.55% in Control 1. Evidently, a more effective bleaching is obtained, if the bleaching chemicals are added in accordance with the invention.

The results also indicate that only a minor part of the shower water applied to the free surface of the grindstone penetrates into the grinding zone, i.e., between wood and grindstone. In turn, this can result in the occurrence of local high temperatures in the grinding zone, when grinding in accordance with the conventional spray technique. This disadvantage would appear to be particularly prominent at the end of the grinding zone, when seen in the direction of rotation of the grindstone. This risk of local overheatinhg is eliminated by the method according to the invention, by continuously applying shower water to the region where the logs are in contact with the grindstone.

Those pulp samples which were subsequently bleached in cans at 80° C. for twenty minutes were analyzed with respect to brightness, and the results are set forth in Table II below:

TABLE II

| | Control 1 | Example 1 |
|---|---|---|
| Brightness according to SCAN, % | 69 | 77 |

As seen from the Table, the brightness has increased by one unit after bleaching for twenty minutes. In itself, the result is surprising because the content of residual peroxide, calculated in percent on the pulp, was slightly higher after producing pulp in accordance with the conventional spraying technique. Possibly, the higher degree of brightness obtained when after-bleaching in the Example according to the invention is due to the higher pulp consistency. In Example 1, the pulp consistency was 3.50%, as opposed to only 1.75% in Control 1. Another reason may be the higher pH obtained in the pulp suspension produced in the method according to the invention. In Example 1, a pH of 8.5 was measured, as opposed to only 7.2 in Control 1.

EXAMPLE 2

This example illustrates the manufacture of bleached groundwood pulp from spruce wood in accordance with the method of the invention, while applying chemical-free shower water to the free surfaces of the grindstone, and shower water containing fresh bleaching chemicals to the end portions of the logs. In Control 2, by way of comparison, groundwood pulp was also produced in accordance with the known technique while applying chemical-free shower water. This was supplemented with a subsequent separate hydrogen peroxide bleaching step.

The same grinder was used in both the example and the control, under the conditions described in Example 1, although with the following differences:

In Example 2, according to the invention, the temperature of the shower water was 85° C. The shower water appplied to the end portions of the logs contained fresh bleaching chemicals, having the following composition and concentration:

| | |
|---|---|
| Hydrogen peroxide | 5.0 g/l |
| $Na_2SiO_3$ (waterglass) | 8.0 g/l |
| Diethylenetriamine pentaacetic acid (DTPA) | 0.5 g/l |
| Measured pH | 11.1 |

The chemical-free shower water was applied to the free surfaces of the grindstone at superatmospheric pressure of 10 kp/cm$^2$ above atmospheric at a rate of 900 linters/minute. The shower water containing fresh bleaching chemicals applied to the end portions of the logs was at a superatmospheric pressure of 12 kp/cm$^2$ above atmospheric, at a rate of 200 liters/minute. Thus, the total volume of shower water applied in this test was at a rate of 1100 liters/minute.

The production of bone dry pulp was calculated at 35 kg/minute. The total charge of bleaching chemicals supplied via the shower water was calculated, in percent on the weight of dry pulp to be:

| | |
|---|---|
| Hydrogen peroxide | 2.85% |
| $Na_2SiO_3$ | 4.55% |
| Diethylenetriamine pentaacetic acid (DTPA) | 0.29% |

Samples of groundwood pulp taken from the closed conduit had a pulp consistency of 3.18%, which constitutes a mean value of five samples. The pulp samples were screened in a laboratory screen having a slot width of 0.15 mm, and hand sheets produced for testing of paper properties. The results are set forth in Table III.

Control 2

The same grinder as that in Examples 1 and 2 was used, but the supply of shower water to the pipes 11 and 12 was stopped. Thus, in this case normal, chemical-free shower water was introduced solely to the free surfaces of the grindstone. The shower water was charged at a rate of 1700 liters/minute, and the discharge pressure was 10 kp/cm$^2$ above atmospheric. The shower water had a temperature of 70° C. Groundwood pulp samples taken from the closed conduit had a pulp consistency of 2.05%. The pulp was tested in the same manner as that recited in Example 2. The results are set forth in Table III.

TABLE III

| | Control 2 | Example 2 |
|---|---|---|
| Canadian Standard Freeness, ml | 195 | 175 |
| Long fiber content according to Bauer McNett (+30 mesh) % | 11 | 25 |
| Tensile index Nm/g | 32 | 43 |
| Tear index, mNm$^2$/g | 3.4 | 5.4 |
| Density, kg/m$^3$ | 360 | 350 |
| Brightness according to SCAN, % | 60 | 76 |

Samples of the groundwood pulp produced in accordance with Control 2 were bleached at a 15% pulp consistency with 3.0% hydrogen peroxide, 5% waterglass and alkali (1.7% NaOH) until a pH of 11.1 was obtained in the bleaching solution. The brightness of the bleached pulp was measured at 76%, i.e., the same brightness as that in Example 2. Despite the fact that the amount of hydrogen peroxide charged in Example 2 was somewhat lower, an equally high brightness was obtained by the method according to the invention as that which can be obtained when bleaching conventionally produced pulp in a separate bleaching step.

Thus, a significant advantage afforded by the present invention is that it makes it possible to produce during the grinding step a groundwood pulp which is so bright as to render additional bleaching in a separate tower unnecessary. This is not possible when applying the conventional spraying technique.

EXAMPLE 3

This example relates to the manufacture of bright groundwood pulp from spruce wood having a low moisture content, in accordance with the method of the invention. The shower water applied to the free surfaces of the grindstone comprised pure water, without the addition of bleaching waste liquor, while the shower water applied to the end portions of the logs contained fresh bleaching chemicals. The electrical power input required during the grinding operation was 2000 kW. By way of comparison, groundwood pulp was produced in the same grinder, and from the same batch of spruce wood, in accordance with the known spraying technique (Control 3) and with the same electrical power input requirements.

In Example 3 according to the invention, debarked spruce logs having an average moisture content of 35% were ground while applying shower water to the end portions of the logs at a rate of 100 liters/minute. This shower water had a pressure of 10 kp/cm$^2$ above atmospheric, and contained the following amounts of fresh bleaching chemicals:

| | |
|---|---|
| Hydrogen peroxide | 1.30 g/l |
| $Na_2SiO_3$ | 6.00 g/l |
| Diethylenetriamine pentaacetic acid (DTPA) | 0.10 g/l |

That shower water simultaneously applied to the free surfaces of the grindstone and having a pressure of 8 kp/cm$^2$ above atmospheric contained no chemicals, and was charged at a rate of 950 liters/minute. The temperature of this shower water was 90° C.

The amount of groundwood pulp produced was calculated to be 33 kg/minute of bone dry pulp. Calculated in percent by weight of bone dry pulp, the total bleaching chemicals charged was:

| | |
|---|---|
| Hydrogen peroxide | 0.39% |
| $Na_2SiO_3$ | 1.82% |
| Diethylenetriamine pentaacetic acid (DTPA) | 0.30% |

Groundwood pulp samples were taken from the closed conduit beneath the grinder, screened in a laboratory screen having a slot width of 0.15 mm, and formed into sheets, and paper tests carried out. The results obtained from the paper tests are set forth in Table IV.

Control 3

In this control, the same grinder was used as in Example 3, with the same electrical power input requirement. Spruce logs having the same low moisture content as those used in Example 3 were used in this control, but the supply of shower water to the pipes 11 and 12 was stopped. Thus, chemical-free shower water was supplied solely to the free surfaces of the grindstone, by the conventional spraying technique. The shower water was charged at a rate of 1800 liters/minute. The discharge pressure of the water was 8 kp/cm$^2$ above atmospheric, and its temperature 70° C.

Groundwood pulp samples were taken from the closed conduit and treated in the same manner as the samples of Example 3. The results are shown in Table IV.

TABLE IV

| | Control 3 | Example 3 |
|---|---|---|
| Canadian Standard Freeness, ml | 140 | 160 |
| Long fiber content according to Bauer McNett (+30 mesh), % | 9 | 23 |
| Tensile index, Nm/g | 28 | 40 |
| Tear index mNm$^2$/g | 3.3 | 4.9 |
| Brightness according to SCAN, % | 59 | 71 |

As seen from the table, the strength and brightness of the pulp produced in accordance with the invention are surprisingly high, in view of the low moisture content of the wood, and the relatively small amount of peroxide charged. It is also seen from the table that when producing a groundwood pulp from wood having a low moisture content, the pulp is much weaker when using the conventional spraying technique.

Thus, an important advantage afforded by the present method is that groundwood pulp of high and uniform quality can be produced, even when the amount of moisture contained by the wood varies greatly.

Having regard to the foregoing disclosure, the following is claimed as the inventive and patentable embodiments thereof:

1. A process for manufacturing from wood logs bleached groundwood pulp of improved and unform quality, which comprises thrusting wood logs contained in at least one wood log pocket of a pocket grinder against the surface of a rotating grindstone while applying shower water onto the free surfaces of the grindstone at an acute angle and applying shower water containing bleaching chemicals directly to the grindstone within the grinding zone where the wood logs in each pocket and the grindstone are in surface contact with each other and to the wood log charge located immediately above the surface of the grindstone at at least one end portion of the wood logs and in substantially parallel alignment with the longitudinal axis of the wood logs at an angle within the range from about 0° to about 60° while controlling the total flow of shower water so that the total volume of water introduced directly into the grinding zone is within the range from about 50 to about 600 liters/minute, for each ton of pulp produced per hour, in a sufficient amount to prevent drying of the wood logs in the course of the frictional heating resulting from their being thrust against the surface of the grindstone, and thus holding the moisture content of the wood logs at a high and uniform level, while bringing the wood logs into effective contact with bleaching chemicals at an early stage, resulting in a pulp of high brightness.

2. A process according to claim 1 which comprises maintaining the hollows between adjacent logs in each pocket filled with shower water.

3. A process according to claim 2 which comprises providing a water trap at the lowermost part of each pocket.

4. A process according to claim 3 in which the water trap comprises elements located at the two plane ends and sides of the grindstone, and other elements connected with the end and side plates arranged around each pocket, in a manner such as to hold the shower water within the hollows between the logs in each pocket.

5. A process according to claim 1 in which the shower water is introduced into the grinding zone of the logs via spray pipes and through holes made in said pipes.

6. A process according to claim 1 in which the shower water is introduced into the grinding zone of the logs via spray pipes and through nozzles mounted on the pipes.

7. A process according to claim 6 in which, in addition to supplying shower water via spray pipes, the shower water is also applied to the logs from above through openings or nozzles arranged in each ram plate of each pocket.

8. A process according to claim 1 in which the shower water is maintained at a superatmospheric pressure within the range from about 0.5 to about 40 kp/cm$^2$ above atmospheric.

9. A process according to claim 1 in which the total amount of shower water supplied per ton of pulp per hour is within the range from about 100 to about 2000 liters/minute, including the shower water supplied to the free surfaces of the grindstone.

10. A process according to claim 1 in which the shower water is filtered before application to the grindstone and wood.

11. A process according to claim 1 in which the temperature of the shower water is within the range from about 65° to about 120° C.

12. A process according to claim 1 in which the temperature of the shower water is within the range from about 80° to about 105° C.

13. A process according to claim 1 in which the bleaching chemicals comprise fresh bleaching chemicals.

14. A process according to claim 13 in which the bleaching chemicals include peroxide bleaching chemicals.

15. A process according to claim 14 in which the peroxide is hydrogen peroxide.

16. A process according to claim 14 in which the peroxide is sodium peroxide.

17. A process according to claim 13 in which the bleaching chemicals include a chelating agent.

18. A process according to claim 13 in which the bleaching chemicals include a magnesium compound.

19. A process according to claim 13 in which the bleaching chemicals include waterglass.

20. A process according to claim 13 in which the bleaching chemicals include alkali.

* * * * *